United States Patent [19]

Raahauge

[11] 4,299,163

[45] Nov. 10, 1981

[54] HIGH SPEED CONDUCTOR CODING APPARATUS

[75] Inventor: Jerald C. Raahauge, Escondido, Calif.

[73] Assignee: Formulabs Industrial Inks, Incorporated, Escondido, Calif.

[21] Appl. No.: 47,764

[22] Filed: Jun. 12, 1979

[51] Int. Cl.[3] ..... B41F 17/10

[52] U.S. Cl. ..... 101/36; 101/157

[58] Field of Search ..... 101/35, 36, 37, 157

[56] References Cited

U.S. PATENT DOCUMENTS

| | | | |
|---|---|---|---|
| 2,630,065 | 3/1953 | Caulfield | 101/157 |
| 2,741,175 | 4/1956 | Heimlicher | 101/157 |
| 2,815,710 | 12/1957 | Pearson | 101/37 |
| 2,818,016 | 12/1957 | Alessi, Jr. et al. | 101/35 |
| 2,898,848 | 8/1959 | Gillies et al. | 101/36 |
| 2,898,849 | 8/1959 | Gillies | 101/37 |
| 2,909,991 | 10/1959 | Farkas | 101/35 |
| 2,934,005 | 4/1960 | Gemelli | 101/37 |
| 3,059,571 | 10/1962 | Worth | 101/35 |
| 3,709,143 | 1/1973 | Rundell | 101/37 |
| 3,739,717 | 6/1973 | Brown et al. | 101/37 |
| 3,752,067 | 8/1973 | Gill | 101/37 |
| 4,021,177 | 5/1977 | Kaiser et al. | 101/37 X |
| 4,077,317 | 3/1978 | Kiesewetter et al. | 101/37 |

*Primary Examiner*—Clifford D. Crowder
*Attorney, Agent, or Firm*—Sellers and Brace

[57] ABSTRACT

Conductor coding apparatus operable at high speed to code a conductor with distinct identifying markings in one or more colors. The apparatus features simplicity, ease of adjustment and servicing, provision for separately collecting all excess coding fluid and for returning excess fluid to the respective supplies thereof, and simple provision for holding the fluid collecting shrouds detachably about each coding disc.

14 Claims, 8 Drawing Figures

FIG. 5.
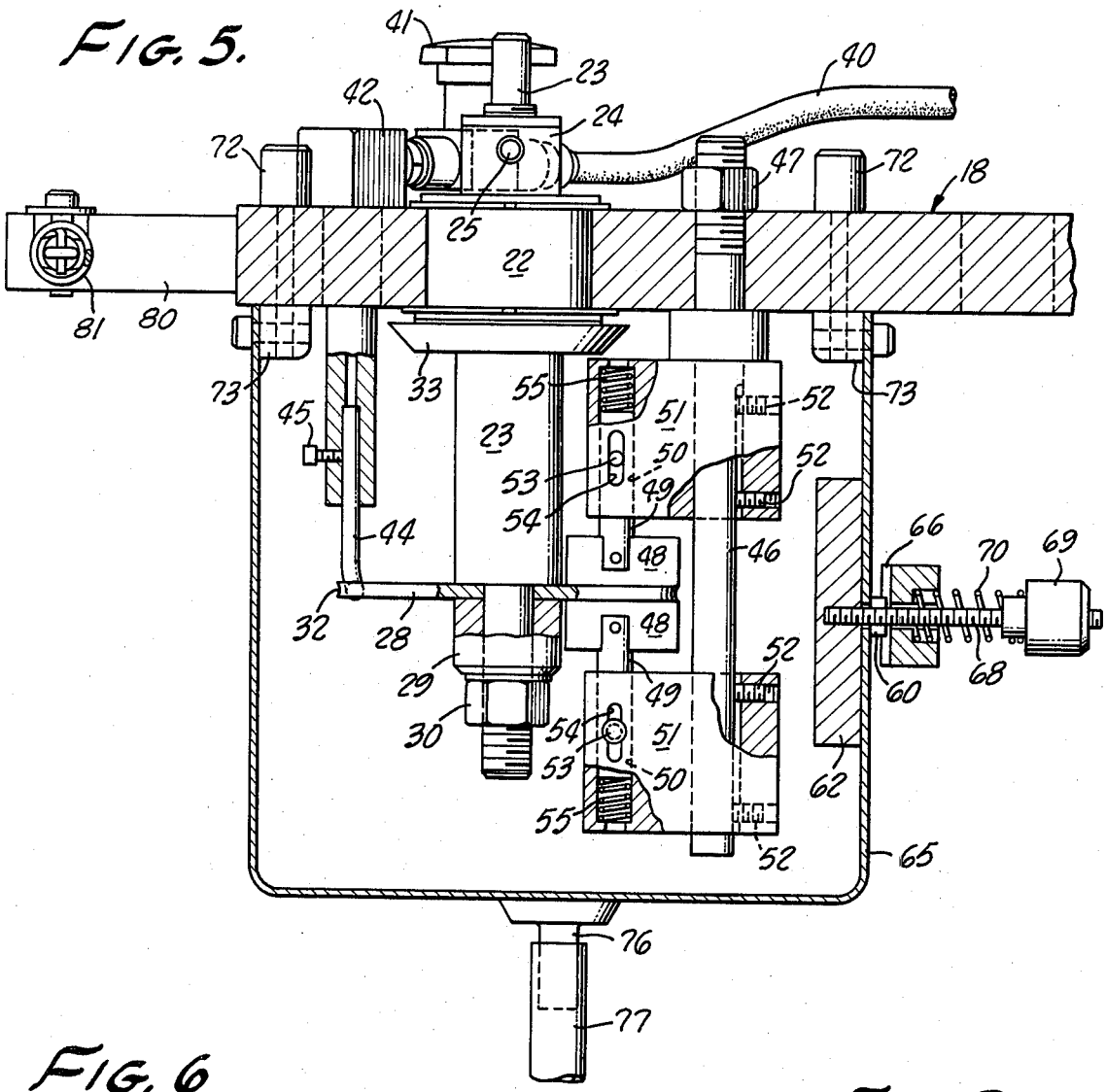
FIG. 6
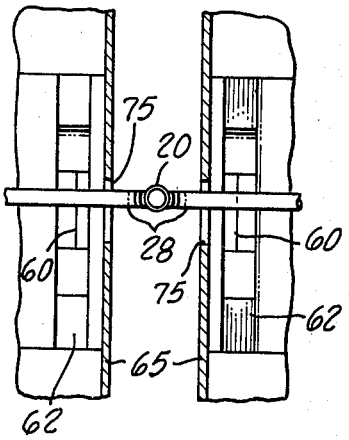
FIG. 7.
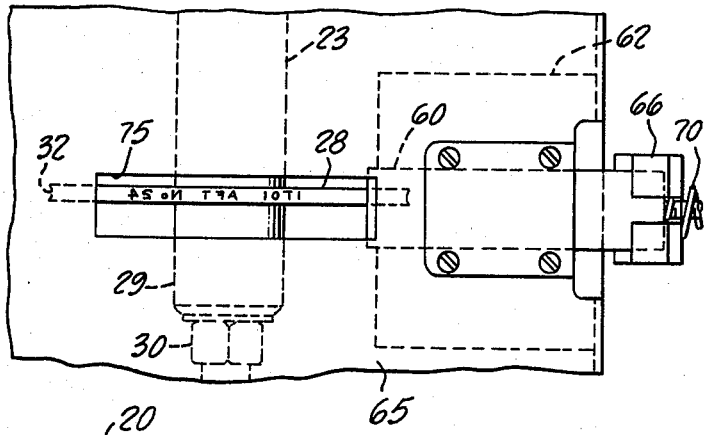
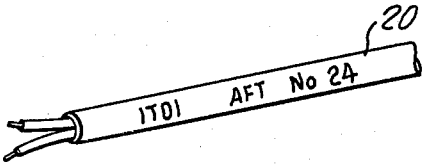
FIG. 8.

HIGH SPEED CONDUCTOR CODING APPARATUS

This invention relates to conductor coding devices, and more particularly to apparatus of this type for applying coding in one or more colors to a conductor at unusually high speed.

BACKGROUND OF THE INVENTION

There is need for impressing conductors and electrical cabling of a wide variety of sizes and types with distinctive symbols and markings useful in identifying and imparting useful information to installers and service technicians. Many proposals have been made heretofore to meet these requirements but the ever-increasing advances in technology impose ever-increasing and taxing demands on the available coding equipment. Modern equipment for extruding insulation jacketing onto conductors is capable of processing conductors at speeds up to and in excess of 2,000 feet per minute. Desirably freshly applied insulation is quite warm and at a favorable temperature for quickly drying films of fluid applied thereto as coding symbols. However, coding equipment available prior to this invention has numerous shortcomings including, in particular, its unsuitability of operating satisfactorily at the conducting insulating speeds of modern extruding equipment. A particularly perplexing problem characteristic of prior wire coding devices when operating at higher speeds involves unsatisfactory and inadequate means for collecting and controlling excess coding fluid. Additionally, presently available equipment capable of simultaneously applying coding in more than one color utilizes a rotating head supporting three rollers operating to apply a like number of continuous stripes to a conductor. Such equipment is relatively expensive and suitable for use with larger diameter conductors. Simpler and less expensive equipment heretofore proposed is limited to operation at speeds of approximately 700 feet per minute and to the use of a single color. Moreover, prior constructions have been complex and costly to manufacture, service and maintain. Cleaning operations are time consuming and difficult.

The following patents typify prior coding equipment: Schake et al U.S. Pat. Nos. 1,958,717; Hargreaves et al 2,344,610; Lowe 2,739,528; Weber 2,836,146; Gillies 2,898,848, 2,898,849; Gemelli 2,934,005, 3,136,242; Burns 3,043,721; Gillies 3,225,688; Wilcocks 3,280,729; Gartside 3,635,153; Rundell 3,709,143; Brown 3,739,717.

SUMMARY OF THE INVENTION

The shortcomings and disadvantages mentioned above and exemplified in the equipment listed in the foregoing patents are avoided by the present invention featuring unusual simplicity, ruggedness, versatility and capability for applying either one or two series of identifying indicia in the same or different colors at high speed and onto the warm insulation as the conductor issues from an insulation extruder. A pair of coding discs bearing intaglio indicia on their rims are rotatably supported beneath separate brackets independently pivotally supported on a common support. The indicia-bearing concave peripheries of the coding discs are spring biased to engage a conductor therebetween. Each disc is provided with highly effective wipers for removing excess fluid and embraced by a separate readily detachable shroud designed to collect all excess coding fluid for return to the supply source. The coding discs are suspended below their supporting bearings thereby safeguarding against the possibility of coding fluid gravitating onto these bearings. A quick release is provided for the biasing spring urging the coding discs against the conductor with the result that these discs may be readily pivoted away from one another for inspection of the discs and the servicing and cleaning of each.

Accordingly, it is a primary object of this invention to provide an improved conductor coding apparatus operable at substantially higher speeds than prior designs and commensurate with the high discharge speeds of modern conductor insulating extruders.

Another object of the invention is the provision of conductor coding apparatus capable of coding conductors simultaneously with the same or different colors and for collecting and returning excess coding fluid to the respective supply sources.

Another object of the invention is the provision of conductor coding apparatus wherein the coding discs are positioned below their supporting bearings and are enclosed by separate readily detachable shrouds for separately collecting excess coding fluid.

Another object of the invention is the provision of conductor coding apparatus wherein the coding discs are mounted on pivotally supported brackets spring biased to press the discs against the opposite sides of a conductor undergoing coding by a common spring readily releasable to permit movement of the coding discs away from the conductor.

Another object of the invention is the provision of wide coding apparatus operable at high speed and the bearings of which overlie the coding discs and are embraced by detachable shrouds designed to capture excess coding fluid.

These and other more specific objects will appear upon reading the following specification and claims and upon considering in connection therewith the attached drawing to which they relate.

Referring now to the drawing in which is preferred embodiment of the invention is illustrated:

FIG. 5 is an enlarged fragmentary cross-sectional view taken along the broken line 5—5 on FIG. 4;

FIG. 6 is a fragmentary cross sectional view taken along line 6—6 on FIG. 4;

FIG. 7 is a fragmentary side elevational view taken generally along line 7—7 on FIG. 4; and FIG. 8 is a perspective view of a short length of conductor imprinted with coding indicia.

Figure 1:
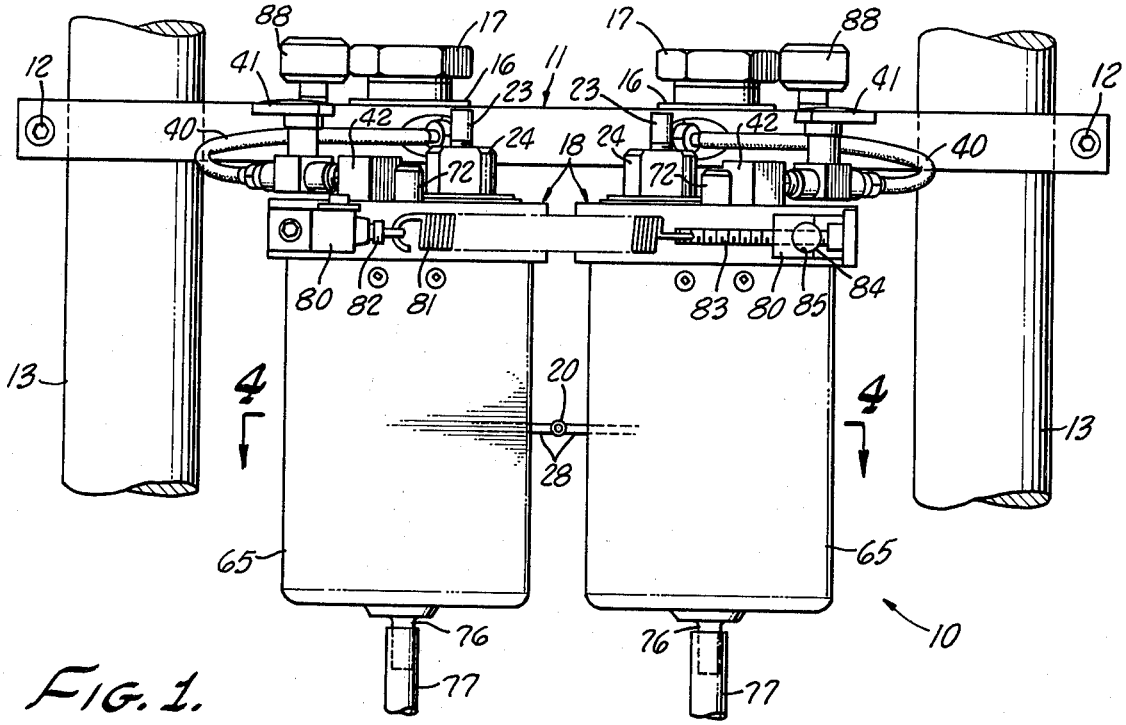
FIG. 1 is a fragmentary front elevational view of an illustrative embodiment of the invention with the conductor undergoing coding clamped between the coding discs.
Figure 2:
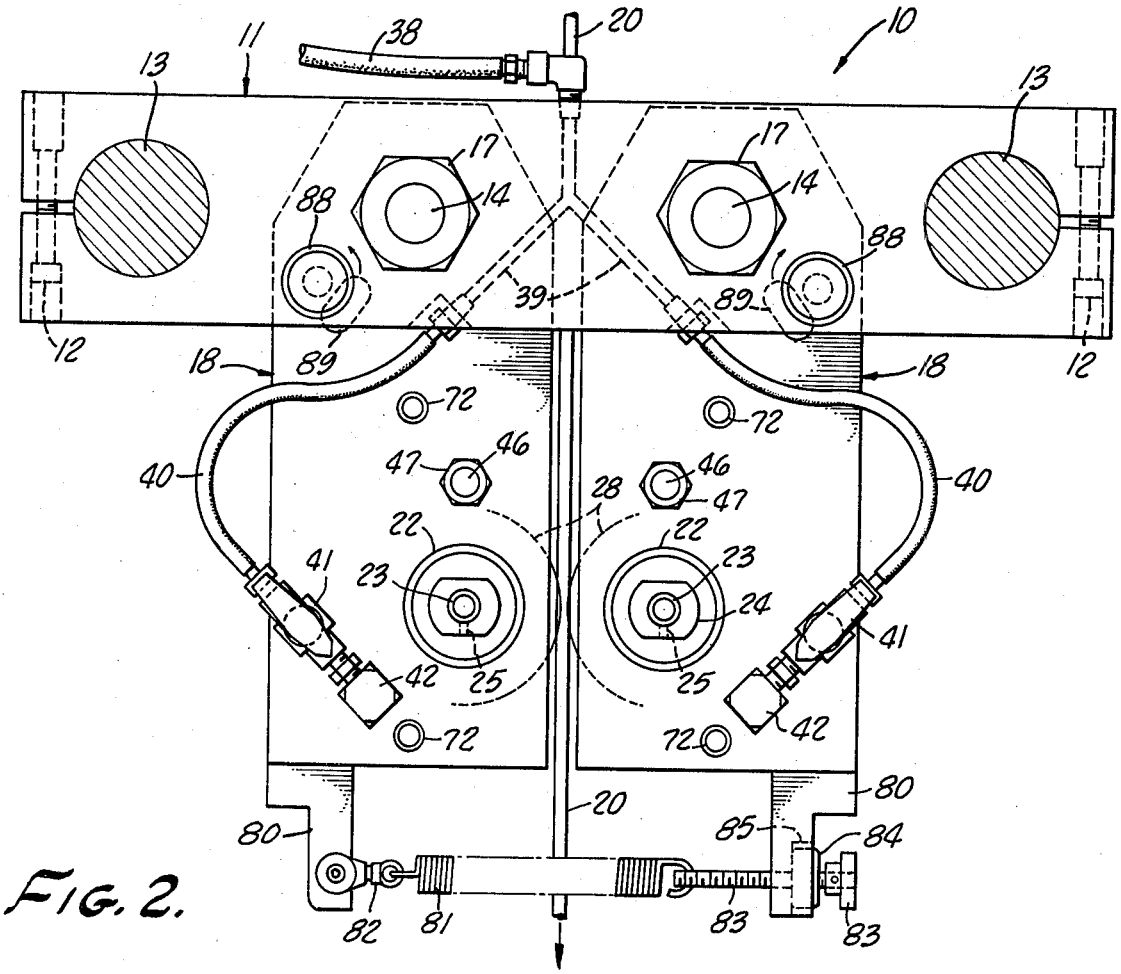
FIG. 2 is a top plan view partly in cross section of FIG. 1.

Referring initially more particularly to FIGS. 1 and 2, there is shown an illustrative embodiment of the wire coding apparatus, designated generally 10, having an elongated main support 11 rigidly clamped, as by clamping screws 12, to a pair of upright firmly supported pedestals 13, 13. A pair of shouldered stub shafts 14, 14 are held pivotally assembled to the main support body by washers 16 and nuts 17.

Figure 3:
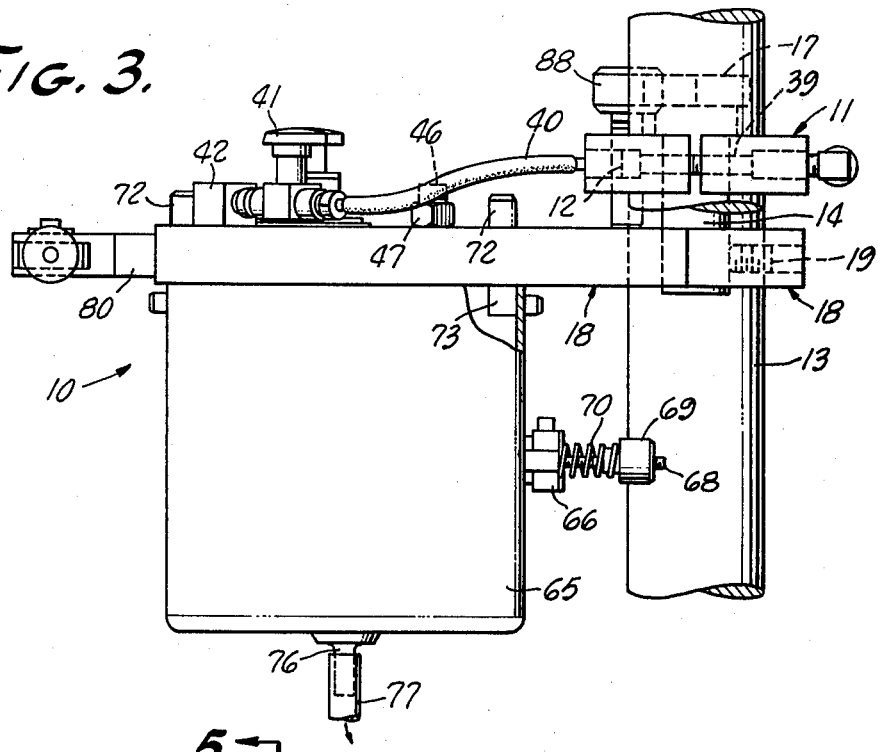
FIG. 3 is a fragmentary elevational view taken along the right side of FIG. 1.

The lower end of stub shafts 14 are provided with flat surfaces (not shown) to which one end of a pair of rigid brackets, 18—18 are clamped by set screws 19 (FIG. 3). One end of each bracket 18 is rigidly supported in a horizontal plane and they have limited freedom of pivotal movement toward and away from one another and an insulated conductor 20. As is made clear by FIG. 2 when the conductor 20 is undergoing encoding, brackets 18 lie generally parallel and closely spaced laterally of one another.

Referring now more particularly to FIGS. 2 to 5, there will be described the conductor coding facilities which are suspended beneath the outer ends of brackets 18, 18. Thus, the outer end of each bracket is provided with an anti-friction bearing 22 in which the upper ends of spindles 23 are journalled and retained in assembled position by a collar 24 and a set screw 25. A coding disc 28 is clamped to the reduced lower end of each spindle by clamping collar 29 and a nut 30. The periphery of discs 28 are concave, as indicated at 32, and shaped and sized to conform generally with the insulation of the conductor 20 being encoded.

Preferably, the upper end of each spindle 23 is provided with a fluid slinger ring 33 having a bevelled edge. This ring is positioned closely below bearing 22 and is highly effective in centrifugally disposing of any coding fluid which may migrate up the spindle and which might enter and foul the bearing except for the slinger.

In accordance with customary practice, the concave periphery 32 of disc 28 is provided with etched indicia which it is desired to be imprinted upon one or both sides of conductor 20 such as that indicated in FIG. 8. Coding fluid is supplied to the peripheries of discs 28 in known manner as via a hose 38 (FIG. 2) discharging into distributing passages 39 in main body 11 and thence through flexible tubing 40 and manually adjustable flow control valves 41 and downwardly through passages in the L-shaped fittings 42. The lower ends of fittings 42 are provided with fluid distributing nozzles 44 held in assembled position by set screws 45. Nozzles 44 are directed to discharge a fine spray of the coding fluid directly onto the concave periphery 32 of discs 28 as is best shown in FIG. 4.

Most of the excess fluid or liquid coding agent discharges readily from discs 28 by centrifugal action, a result greatly facilitated by the polished upper and lower surfaces of the discs as well as of all portions of the concave periphery except that etched indicia. Any remaining portions are efficiently removed by several wipers, best illustrated in FIGS. 4 and 5, which will now be described. One pair of wipers are supported on a shouldered spindle 46 clamped to the underside of each bracket 18 by a nut 47. Suitable wiper blades 48, 48 are pivotally supported in the bifurcated ends of pins 49 reciprocally supported in the bores 50 of holders 51 adjustably clamped to spindle 46 by set screws 52. Each pin 49 and its wiper 48 are biased toward the adjacent surface of disc 28 by a compression spring 55. Pins 49 are held in assembled position in holders 51 by a radial pin 53 extending loosely into a keeper slot 54.

Figure 4:
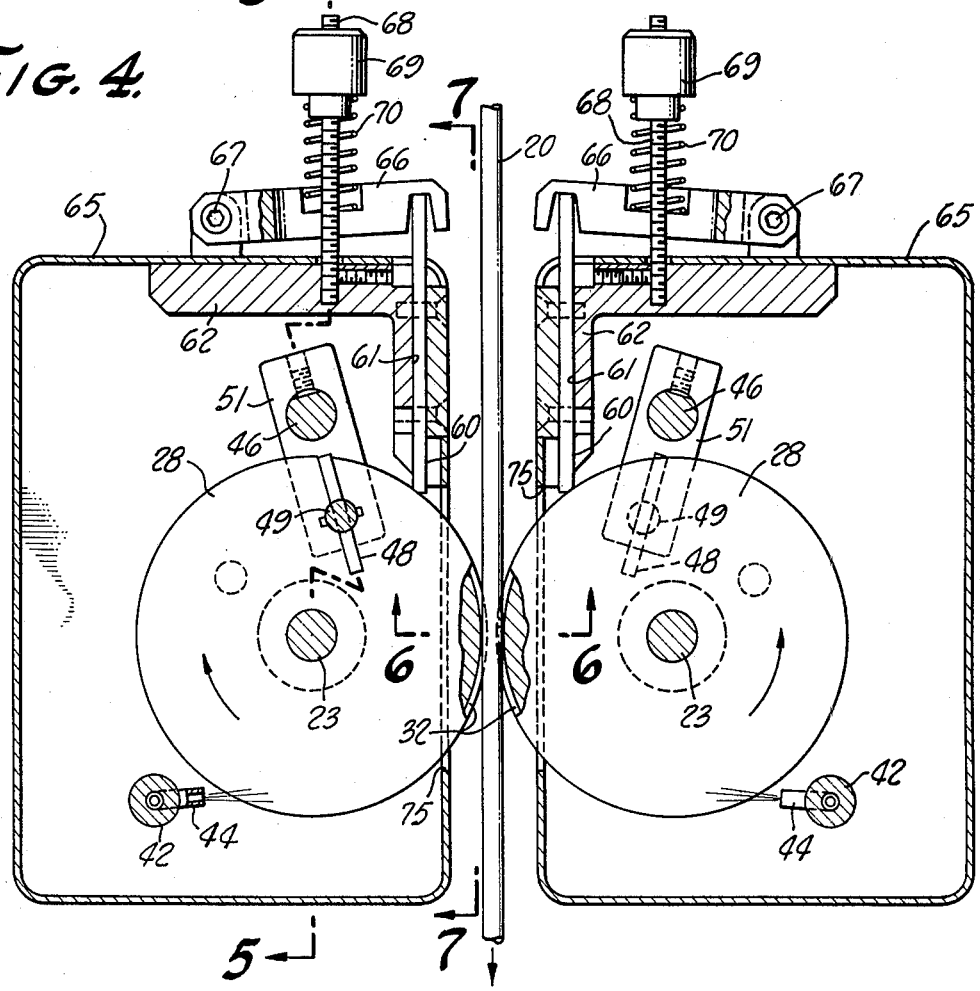
FIG. 4 is an enlarged cross-sectional view taken along line 4—4 on FIG. 1.

The resiliently biased fluid wipers for the periphery of discs 28 are best shown in FIGS. 4, 5 and 7 which will now be described. The wiper blade proper 60 (FIG. 4) is slidably supported in a passage 61 formed in an L-shaped support member 62 suitably secured to the sidewalls of the cup-shaped fluid collecting shroud chambers 65, 65. The inner ends of wipers 60 are shaped to conform with the concave periphery of disc 28 and the outer ends project outwardly from the adjacent wall of chambers 65. Each wiper is resiliently urged inwardly by a lever arm 66 pivoted to the exterior of each shroud on a pivot pin 67. A threaded spindle 68 mounted in members 62 supports thumb nuts 69 which are readily adjusted to vary the pressure of springs 70 on lever arms 66. It will be understood that wipers 48 and 60 are made of any suitable material as, for example, nylon or the like long-wearing low-friction material.

The highly important shroud chambers 65 are cup-shaped and their lip edges fit snugly against the underside of brackets 18 in the manner best shown in FIG. 5. The shrouds are held detachably in this position by thumb nuts 72 having threaded shanks extending through holes in brackets 18 and into threaded bores of retainer nuts 73 secured to the upper inner edges of shrouds 65. Typically, a pair of thumb nuts 72 suffices to hold each shroud detachably in place. These shrouds are highly effective in collecting and retaining captive all excess fluid discharging from nozzles 44 and not used in imprinting the coding indicia on Conductor 20. As is best shown in FIG. 4, only a short peripheral length of discs 28 is exposed outside shroud chambers 65, the sidewalls of these chambers being provided with a slot 75 (FIG. 7) for this purpose. The bottom of each shroud is provided with an outlet nipple 76 to which a hose 77 is connected extending back to the supply reservoir or other suitable collecting chamber for collected excess fluid.

Suitable means for holding disc 28 in firm contact with conductor 20 will now be described with reference to FIGS. 1 and 2. As there shown by way of example, the outer ends of each of the brackets 18, 18 are provided with an L-shaped bracket 80, 80. One end of a stiff tension spring 81 is permanently anchored to the left hand bracket 80 by a swivel 82 whereas the other end is hooked into an opening in the end of an adjusting thumb nut 83. Threaded about the shank of this thumb nut is a nut 84 which seats non-rotatably in a bifurcated socket 85 formed in the right hand bracket 80.

When the tensioning spring 81 and thumb nut 83 are assembled as shown in FIG. 2, it will be evident that the spring is effective to hold the two brackets 18, 18 biased toward one another to press disc 28 against the opposite sides of the conductor 20 to be imprinted with indicia. The pressure of the disc against the conductor can be regulated by adjusting thumb nut 83 while the nut 84 is retained against rotation in socket 85.

When the operator wishes to release brackets 18, he merely grabs thumb nut 83 and lifts nut 84 out of socket 85 whereupon each bracket is free to pivot away from the conductor about the axis of stub shafts 14, 14. After inspection or other servicing operations, the apparatus is restored to operation quickly and effortlessly by pivoting the arms together and re-inserting nut 84 in socket 85.

A further feature preferred by many users comprises manual stop means normally permitting the two brackets 18 to pivot only a short distance away from their normal coding position. Suitable stop means for this purpose is best shown in FIG. 2 as comprising a thumb nut 88 having its threaded shank mated with a threaded bore in main support 11. The shank of this thumb nut extends through support 11 and into a slot 89 formed on each bracket 18. This slot has a width greater than the diameter of the lower end of the thumb nut. Accordingly, if the thumb nut is lowered into slot 89 brackets 18 can pivot only through a short arc toward and away from conductor 20. However, if one or both thumb nuts are screwed outwardly until the lower end is free of slots 89, one or both brackets 18 may be pivoted freely away from one another and to the extent permitted by the supporting pedestals 13, 13.

The operation of the described wire coding apparatus will be quite apparent from the foregoing description of the components and their operative relationship to one another. Customarily, wire from the insulation extruding apparatus in hot condition is fed directly between the concave peripheries of discs 88 to a take-up reel, not shown. Owing to the fast setting and drying characteristics of the coding fluid and the warm condition of the freshly insulated wire, operating speeds of 2,000 to 3,000 feet per minute are typically achieved. Eighty percent less coding fluid or liquid is customarily required because of the highly efficient action of wipers 48 and 60 in removing excess fluid and the efficiency of the shroud chambers in capturing and returning the excess to the main supply. Different sized conductors are readily processed by substituting and appropriately sized pair of discs 28 and insulated conductors varying in size from 20 mils to one half inch are successfully coded. More than one color of coding may be applied if separate supply hoses for the two colors are employed.

While the particular high speed conductor coding apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. Apparatus for imprinting an insulated conductor at a rate of hundreds of feet per minute comprising:

means rigidly supporting a horizontally disposed main support across the upper end of said apparatus;

a pair of printing discs with concave indicia-bearing conductor-engaging peripheries, said printing discs being suspended on upright shafts journaled in bearings mounted in separate overlying brackets carried by said main support and at least one of which is pivotally mounted thereon;

means biasing said brackets toward one another to press said discs against the opposite sides of a conductor so as to be rotated by the conductor as it is pulled therepast;

means for applying a liquid printing agent to the indicia in the concave peripheries of said discs; and separate shroud means underlying and carried by a respective one of said brackets and substantially enclosing a respective one of said printing discs and each having a slot in the sidewall thereof through which a rim portion only of these associated disc projects.

2. Apparatus as defined in claim 1 characterized in the provision of separate upwardly-facing cup-shaped shroud means depending from and mounted on said brackets and embracing the major portion of a respective one of said discs and having an elongated opening in the sidewall thereof through which a portion of said discs projects.

3. Apparatus as defined in claim 2 characterized in the provision of a rigid support fixed to the underside of each of said brackets and supporting wiper means bearing against the opposite sides of a respective one of said discs to wipe excess liquid therefrom.

4. Apparatus as defined in claim 3 characterized in the provision of spring-pressed wiper means carried by said shroud means and bearing against the concave periphery of said discs to wipe away excess liquid therefrom as the wiped periphery approaches contact with a conductor undergoing marking with liquid indicia.

5. Apparatus as defined in claim 4 in which each of said wiper means includes means for adjusting the pressure thereof against the associated one of said discs.

6. Apparatus as defined in claim 2 characterized in that said cup-shaped shroud means includes means for holding the same detachably to the underside of a respective one of said brackets.

7. Apparatus as defined in claim 6 characterized in that said cup-shaped shroud means are normally seated against and closed by the overlying portion of the associated one of said brackets.

8. Apparatus as defined in claim 6 characterized in the provision of means for draining excess liquid agent collecting in the bottom portions of said shroud means away therefrom.

9. Apparatus as defined in claim 1 characterized in that said means for applying liquid to the periphery of said discs includes a liquid jetting nozzle mounted on the underside of each of said brackets and positioned to jet liquid from a supply thereof onto the periphery of a respective one of said discs.

10. Apparatus as defined in claim 1 characterized in the provision of adjustable stop means on said bracket support means normally positioned to restrict the pivotal movement of said brackets to a small arc closely adjacent the opposite lateral sides of a conductor to be marked with indicia.

11. Apparatus as defined in claim 10 characterized in that said adjustable stop means includes a separate stop for each of said brackets.

12. Apparatus as defined in claim 10 characterized in that said adjustable stop means is adjustable to a retracted position leaving a selected one or both of said brackets free to pivot unrestrained by said stop means.

13. Apparatus as defined in claim 1 characterized in that said means rotatably supporting said discs includes a slinger disc adjacent the underside of each of said brackets having a circular sharp-edged rim operable to sling liquid when present thereon onto the interior surface of said shroud means.

14. Apparatus as defined in claim 1 characterized in that said support for said bracket bearings includes an elongated rigid member adjustably supported at its ends on upright pedestal means.

* * * * *